US005851930A

United States Patent [19]

Bessey et al.

[11] Patent Number: 5,851,930

[45] Date of Patent: Dec. 22, 1998

[54] RIGID FIBER NETWORK STRUCTURES HAVING IMPROVED POST-YIELD DIMENSIONAL RECOVERY, METHOD OF MAKING SAME, AND ARTICLES INCORPORATING SAME

[75] Inventors: William E. Bessey, Charlotte, N.C.; Gerald Peter Rumierz, Tega Cay, S.C.; Clinton Dale Felton, Charlotte, N.C.

[73] Assignee: Hoechst Celanese Corp., Warren, N.J.

[21] Appl. No.: 976,648

[22] Filed: Nov. 24, 1997

[51] Int. Cl.[6] ..... D03D 3/00

[52] U.S. Cl. ..... 442/60; 156/148; 156/196; 156/245; 156/272; 156/275.5; 156/275.7; 156/307.7; 428/156; 428/172; 428/175; 428/178; 442/205; 442/304

[58] Field of Search ..... 442/60, 205, 304; 428/156, 172, 175, 178; 156/148, 196, 245, 272, 275.5, 275.7, 307.7

[56] References Cited

U.S. PATENT DOCUMENTS

| | | | |
|---|---|---|---|
| 4,631,221 | 12/1986 | Disselbech et al. | 428/178 |
| 4,890,877 | 1/1990 | Ashtiani-Zagadi et al. | 276/146 |
| 5,158,821 | 10/1992 | Gebauer et al. | 428/174 |
| 5,364,686 | 11/1994 | Disselbech et al. | 428/174 |
| 5,447,776 | 9/1995 | Disselbech et al. | 428/178 |
| 5,731,062 | 3/1998 | Kim et al. | 428/175 |

*Primary Examiner*—James J. Bell
*Attorney, Agent, or Firm*—James L. McGinnis

[57] ABSTRACT

A rigid three-dimensionally shaped fiber network structure having improved post-yield dimensional recovery is composed of a deformed textile fabric network structure containing: (A) at least one oriented, semi-crystalline monofilament yarn containing a thermoplastic polymer and disposed in the deformed fabric so as to provide a plurality of monofilament cross-over points therein; and (B) a cured crosslinkable resin impregnating the deformed network structure so as to effect bonding of all or substantially all of the monofilament cross-over points. The network structure is made by subjecting the monofilament yarn to a fabric-forming process to form a deformable fabric, subjecting the deformable fabric to an area-enlarging deformation process to form the initial three-dimensionally shaped network structure composed of a deformed textile fabric, demolding the initial network structure and then curing the crosslinkable resin, which has been added before the deformation process, before demolding and/or after demolding. Curing of the crosslinkable resin bonds all or substantially all of the monofilament cross-over points, thereby converting the initial network structure into a rigid final network structure having improved post-yield dimensional recovery.

25 Claims, No Drawings

RIGID FIBER NETWORK STRUCTURES HAVING IMPROVED POST-YIELD DIMENSIONAL RECOVERY, METHOD OF MAKING SAME, AND ARTICLES INCORPORATING SAME

BACKGROUND OF THE INVENTION

This invention relates to shaped fiber network structures. More particularly, this invention relates to three-dimensionally shaped fiber network structures which are rigid and have improved post-yield dimensional recovery. Furthermore, this invention relates to improved methods of making such structures and to articles incorporating such structures.

Three-dimensionally shaped fiber network structures and methods of making them are known in the art.

For example, such structures have been made by multi-step processes involving impregnating a fabric with a high level of thermoset resin, deforming the resin-impregnated fabric into the desired network shape, and then curing the thermoset resin so as to lock the structure in such desired shape. These methods are taught, for example, in U.S. Pat. Nos. 4,631,221; 4,890,877; 5,158,821; and 5,447,776.

The resin-based network structures formed by the process described above have several disadvantages. For example, both the compression properties and the stiffness properties of the resin-based network structures (which are derived from conventional textile-type yarns) are determined by the type and amount of resin present in the structure. In fact, resin loading is the limiting factor in network stiffness. Increasing the stiffness of the network structure requires progressively higher loadings of resin. A typical resin-based network will contain more than 50% by weight of thermoset resin. Very stiff network structures are usually in the form of composites constructed by nesting single network structures.

The prior art resin-based networks are composed of multifilament yarns and a stiff but brittle matrix material. When the dome structures in these networks are compressed, the network elements are bent. Because all of the fiber crossover points are tightly bonded, bending is highly localized, i.e., bending occurs in the short lengths between the fiber crossover points. Even at small dome compressions, some network elements are highly strained while others are under no strain. Kinking (brittle failure) of the most highly bent elements occurs at low overall network compressions (less than 30%). Once an element kinks, it behaves like a hinge and offers no further resistance to bending. The network has yielded and offers reduced resistance to further compression. Since the kinking or buckling is permanent, the network cannot recover its original height or shape when the kink-inducing compression is removed. Because the network structure cannot recover its original height or shape when its yield load has been exceeded, the network structure is described herein as having "low post-yield dimensional recovery".

Another drawback of the prior art resin-based network structures is that their maximum stiffness tends to be limited by the natural tendency of textile yarns to flatten, thus presenting the thinnest, softest cross-section when bent.

Because the prior art resin-based network structures are usually stiff and brittle and suffer permanent deformation when compressed beyond 10% to 20% of their thickness, the use of such network structures is generally limited to light-weight structural applications.

The prior art process described previously herein for making the resin-based network structures discussed above also has drawbacks. For example, the process requires a separate costly initial resin treatment. In addition, the fabric used in the process is not particularly stable since, until its deformation, the fabric must be maintained at a temperature below the curing temperature of the resin. Furthermore, the deformation process is time-consuming since it is controlled by the amount of time required to heat up the mold, the fabric and the resin and the amount of time required to cure the resin. Thus, although the prior art resin-based network structures have found use in a number of applications such as, e.g., building panels, automotive doors, flooring systems, and geotextiles, use of these network structures is limited primarily by the high cost of making them.

To overcome the difficulties associated with the above-described resin-based process, methods of making resin-free three-dimensionally shaped fiber network structures were introduced. For example, resin-free network structures have been formed using multifilament yarn textile fabrics consisting of high melting temperature reinforcing filaments and lower melting temperature thermoplastic matrix filaments, wherein the network structure is formed by melting the matrix filaments, forming the desired network shape, and re-solidifying the matrix material prior to demolding. Such a method and resin-free structure are disclosed, e.g., in U.S. Pat. No. 5,364,686.

The properties of the resin-free network structure formed by the process described in U.S. Pat. No. 5,364,686 are similar to those of the aforementioned resin-based network structures. Although simpler and cleaner than the methods for making the resin-based network structures, the method described in U.S. Pat. No. 5,364,686 for making resin-free network structures is extremely slow because the matrix polymer must be melted, shaped and then cooled below its melting temperature and allowed to harden sufficiently so that the network shape can be maintained prior to demolding.

A drawback to both the resin-based and resin-free prior art processes described hereinabove is that before the deformed network structure can be removed from the mold the thermoset resin must be cured in the resin-based process or the low melting thermoplastic must solidify in the resin-free process. This is time-consuming.

Another drawback to the resin-based and resin-free prior art processes described hereinabove is that both processes use multifilament yarns to form the network structures therein. The use of multifilament yarns to form such network structures has several disadvantages. For example, multifilament yarns generally cannot support their own weight unless the individual fibers therein are bonded together (i.e., the multifilament yarns are "limp"). However, bonded multifilament yarns are also disadvantageous in that they can delaminate along weaknesses when they are flexed and consequently become dramatically softer. In addition, multifilament yarns tend to flatten to form the softest cross-section, i.e., a ribbon, during the network-forming process. This limits the achievable compression modulus.

Both the resin-based and resin-free network structures produced by the prior art processes described above are rigid, quasi-brittle structures. Both types of structures are stiff and can be deformed only a limited amount before yielding and acquiring a permanent deformation.

More recently, resin-free three-dimensionally shaped fiber network structures have been formed using large-diameter thermoplastic polymer monofilaments having a diameter of at least about 0.1 millimeter. Such monofilament-based structures are disclosed, for example, in copending, commonly assigned U.S. patent application Ser. No. 08/577,655 to Kim et al., filed Dec. 22, 1995.

In the monofilament-based network structures disclosed in the Kim et al. application, the limp multifilament yarns and brittle resins are replaced with large diameter monofilament yarns. When these network structures are compressed, the stiff monofilament yarns are bent. However, since the fiber crossover points are not bonded, the total bending strain is distributed over longer lengths of yarn. The resistance to compression can still be significant but the local fiber strains are much lower than in the rigid networks. These networks can sustain much greater total compression, e.g., 60% or more, without any fiber kinking. Consequently, these networks are intrinsically softer than the prior art rigid networks but are highly resilient. Recovery from repeated 50% compressions is typically 95% to 100%.

Because of the bending stiffness of the large-diameter monofilaments used therein, the network structures formed by the Kim et al. method exhibit a nearly Hookean resistance to compression and exhibit excellent recovery from multiple compressions up to at least 50% of their original height. Unfortunately, the springiness and high deflections of such network structures under working loads make these structures too soft for many industrial and structural applications such as, for example, lightweight cores for sandwich panels and structural spacers.

Thus, it would be desirable to provide a network structure and method of making same, wherein the network structure has both improved post-yield dimensional recovery and sufficient rigidity to be useful in industrial and structural applications such as, e.g., the aforementioned lightweight cores for sandwich panels and structural spacers.

Therefore, it would be desirable to provide a network structure and a method of making same wherein the structure and method overcome the difficulties associated with the prior art resin-based, resin-free, and monofilament-based network structures and methods described hereinabove.

Accordingly, a primary object of this invention is to provide a three-dimensionally shaped fiber network structure which has improved post-yield dimensional recovery and improved rigidity.

A further object of this invention is to provide a three-dimensionally shaped fiber network structure having improved post-yield dimensional recovery and rigidity, wherein the structure does not depend upon high levels of a bonding agent to achieve acceptable stiffness levels.

Still another object of this invention is to provide a three-dimensionally shaped fiber network structure having improved post-yield dimensional recovery and rigidity, wherein the structure has optimum elemental cross sections for bending resistance.

A further object of this invention is to provide a relatively economical, fast and easy method of making a three-dimensionally shaped fiber network structure having the properties set forth in the preceding objects.

A still further object of this invention is to provide a method of making a three-dimensionally shaped fiber network structure having the properties set forth in the preceding objects, wherein the deformed network structure has sufficient initial stiffness that it can be removed from the mold immediately after the deformation process.

Another object of this invention is to provide articles composed of a three-dimensionally shaped fiber network structure having the properties set forth in the preceding objects.

These and other objects which are achieved according to the present invention can be discerned from the following description.

SUMMARY OF THE INVENTION

The present invention is based in part on the discovery that heated, semi-crystalline, oriented thermoplastic monofilaments can be rapidly shaped into stable three-dimensionally shaped fiber network structures. Thus, the use of such monofilaments provides a relatively fast, simple and economical method of making such structures. The present invention is further based on the discovery that such network structures can be made surprisingly stiff by the simple expedient of bonding the monofilament cross-over points in the monofilament yarn. In addition, the present invention is based on the discovery that network structures based on semi-crystalline, oriented thermoplastic monofilament yarns have improved post-yield dimensional recovery properties than do multifilament-based network structures.

Accordingly, one aspect of the present invention is directed to a rigid three-dimensionally shaped fiber network structure having improved post-yield dimensional recovery properties and containing a deformed sheet-like textile fabric having a base region and a plurality of deformations formed as a two-dimensional array on the base region. The deformed fabric is composed of:

(A) at least one oriented, semi-crystalline monofilament yarn composed of a thermoplastic polymer and being disposed in the fabric so as to provide a plurality of monofilament cross-over points therein; and (B) a cured crosslinkable resin impregnating the fabric so as to effect bonding of all or substantially all of the monofilament cross-over points.

The present invention is further directed to methods of making the aforementioned three-dimensionally shaped fiber network structure.

A first and preferred method for making the network structure of this invention involves the steps of:

(1) providing at least one oriented, semi-crystalline monofilament yarn composed of a thermoplastic polymer;

(2) subjecting the monofilament yarn to a fabric-forming process so as to produce a deformable fabric, the deformable fabric containing a plurality of monofilament cross-over points provided by the monofilament yarn;

(3) subjecting the deformable fabric to an area-enlarging deformation process in a shaping mold at an elevated temperature so as to form an initial, resilient, self-supporting network structure containing a deformed fabric having a three-dimensional shape, the deformed fabric having a base region and a plurality of deformations disposed as a two-dimensional array on the base region, the elevated temperature being higher than the glass transition temperature of the thermoplastic polymer so as to permanently deform the thermoplastic polymer but sufficiently below the melting temperature of the thermoplastic polymer so as to avoid softening and loss of molecular orientation of the thermoplastic polymer, the initial network structure having sufficient stiffness so as to be capable of maintaining the three-dimensional shape thereof;

(4) removing the initial structure from the shaping mold;

(5) adding a crosslinkable resin to the demolded initial structure to form a resin-impregnated structure; and (6) curing the crosslinkable resin in the resin-impregnated structure so as to bond all or substantially all of the monofilament cross-over points, thereby converting the initial structure into a rigid three-dimensionally shaped network structure having improved post-yield dimensional recovery properties.

In a second method for making the network structure of this invention, the resin is added to the deformable fabric rather than to the demolded network structure. Thus, in this method, the resin is added after the fabric-forming step but before the deformation and demolding steps. The resin-impregnated deformable fabric is then subjected to the area-enlarging deformation process to form a resin-impregnated initial structure, which is then demolded. The resin in the demolded structure is then cured so as to effecting bonding of all or substantially all of the monofilament cross-over points, thereby forming the final network structure of this invention.

In a third method for making the network structure of this invention, the resin is added to the initial network structure (i.e., the deformed fabric) prior to the demolding of such network structure. The resin-impregnated initial network structure is then demolded and the resin cured to bond all or substantially all of the monofilament cross-over points to form the final network structure.

A third aspect of the present invention is directed to articles incorporating the fiber network structure of this invention.

The production of rigid, three-dimensionally shaped fiber network structures from semi-crystalline, oriented monofilament yarn instead of from multifilament yarn as is done in the prior art processes described previously herein has numerous advantages, both in terms of the product and the process.

For example, because the monofilament yarn is the primary source of stiffness of the network structure of this invention, the ultimate properties of such network structure depends much less on the choice and level of bonding agent than do the above-described resin-based network structures of the prior art. This is because the large-diameter monofilaments are stiff enough to support the network structure even if the network structure is removed from the mold before the resin cures. In the method of the present invention, the curing of the crosslinkable resin can be delayed until after the network structure has been demolded. On the other hand, multifilament yarns cannot support their own weight unless the individual fibers are bonded together. Thus, the prior art methods for making fiber network structures require that the thermoset resin be cured or that the low melt thermoplastic be hardened before demolding of the network structure can occur. Therefore, unlike the multifilaments used in the prior art processes, the semi-crystalline, oriented, large-diameter monofilament yarn used in the method of this invention easily maintains its shape without the benefit of a stiffening system such as a thermoset resin or a second thermoplastic polymer.

In addition, because of the intrinsic stiffness of the monofilament yarn and the need to bond only the monofilament cross-over points therein as opposed to bonding the individual filaments together as in the multifilament version, a significantly lower amount of the crosslinkable resin can be used in the present invention to achieve high stiffness values than is the case in the prior art processes discussed above.

Monofilament-bases fabrics generally have a stiffer cross-section and are more robust than the open-structure, multifilament-based fabrics disclosed in the aforementioned prior art references. Thus, large-diameter monofilament yarns do not normally flatten during the deformation process. On the other hand, multifilament yarns used in the prior art network structures tend to be relatively delicate structures which will flatten during the network-forming process to form the softest cross-section, i.e., a ribbon, thereby limiting the achievable compression modulus. Monofilament yarns with a round cross-section will provide maximum bending stiffness, while monofilament yarns with a non-round cross-section will twist, rather than flatten, to present a softer cross-section. The integrity of the monofilament cross-section assures a uniform, controllable flex modulus.

Furthermore, the fiber network structure of this invention is surprisingly stiff when compared to the resilient, unbonded monofilament network structures disclosed in copending, commonly assigned U.S. patent application Ser. No. 08/577,655 to Kim et al., which was previously mentioned herein. Although the monofilament-based network structure of this invention is not as resilient as the unbonded monofilament networks, the network structure of this invention retains a higher percentage of its initial stiffness and recovery properties than do the prior art multifilament-based network structures taught in, e.g., U.S. Pat. Nos. 4,631,221 and 5,364,686.

Like prior art rigid networks, the network structure of the present invention is bonded at the fiber crossover points. Consequently, the bending is localized and the resistance to compression rises rapidly. However, because the intrinsic stiffness of the network segments derives from both the fibers themselves and the bonding material, as network compression increases, the local stress will exceed the strength of the fiber crossover bonds before the fibers can kink. When the bonds break, the deformation redistributes over longer fiber lengths. The material yields, i.e., it becomes softer but it retains its ability to recover from deformation. When the compression is removed, the network height will be recovered. Resistance to subsequent compression will be reduced but still significant. If, after recovery, the broken bonds are reconnected, e.g., by adding additional "glue" or by re-melting the low melt thermoplastic, the network can be repaired and regain its original stiffness.

In addition, the monofilament-based rigid network structure of this invention has greater post-yield dimensional recovery than do the conventional multifilament-based rigid network structures of the prior art. In other words, the rigid network structures of this invention are less prone to experiencing catastrophic collapse after yield than are the prior art structures.

The method of this invention also has several advantages.

For example, the method of this invention is easier to control than are the prior art processes using multifilament yarn.

In addition, the method of this invention is more economically viable than are the multifilament-based methods of the prior art because network structures can be formed much faster with the monofilament-based method of this invention than with the multifilament-based prior art processes. The thermal memory of semi-crystalline, oriented monofilaments is strongly dependent upon the maximum temperature the monofilaments have reached but only weakly dependent upon the time spent at that temperature. Consequently, demolding of the monofilament-based network structure of this invention can be accomplished as soon as the deformed fabric reaches the desired temperature. If the deformable fabric is preheated close to but below the final temperature, cycle times can be reduced to as low as a few seconds. On the other hand, because multifilament networks cannot support their own weight unless the individual fibers are bonded together, prior art network-forming processes using multifilament yarns require that the thermoset resin be cured or the lower melting thermoplastic polymer be solidified prior to removing the network structure from the mold, i.e., the curing operation is delayed until after the network structure has been formed. Thus, the use of semi-crystalline, oriented monofilaments in the method of this invention allows the network structure of this invention to be formed more rapidly than the multifilament-based network structures of the prior art.

A further advantage of the present invention is that the intermediate material, i.e., the deformed initial network structure, can be stored and even shipped in compact roll form, if curing and rigidizing the structure is delayed.

DETAILED DESCRIPTION OF THE INVENTION

As stated hereinabove, the present invention provides a three-dimensionally shaped fiber network structure having improved rigidity and post-yield dimensional recovery. In addition, the present invention provides methods of making the network structure, as well as articles composed of such network structure.

The three-dimensionally shaped fiber network structure of this invention has an open-mesh, filigree-like appearance and is composed of a deformed textile fabric produced by subjecting a deformable textile fabric to an area-enlarging deformation process carried out at an elevated temperature in a shaping mold. The deformed textile fabric has a base region and a plurality of deformations disposed as a two-dimensional array along and across the base region.

The deformable textile fabric is preferably either a knitted or woven fabric. Knitted fabrics are drapable and can be readily deformed without excessive elongation of the individual fibers therein, which can lead to breakage of the fibers. Woven fabrics can be more readily produced from large-diameter monofilaments.

The deformed fabric contains (A) at least one oriented, semi-crystalline monofilament yarn composed of a thermoplastic polymer, the monofilament yarn being disposed in the deformed fabric so as to provide a plurality of monofilament crossover points therein; and (B) a cured crosslinkable resin impregnating the deformed fabric so as to effect bonding of all or substantially all of the monofilament cross-over points. As used herein, the term "monofilament cross-over points" refers to those points in the deformed fabric wherein the monofilament yarn crosses over (intersects) itself. The monofilament cross-over points are not bonded to each other in either the deformable fabric or the deformed fabric. Instead, the monofilament cross-over points remain unbonded until the resin is cured. Thus, the resin acts as a bonding agent for the monofilament cross-over points.

The monofilament yarn used in the present invention is an oriented, semi-crystalline yarn. In the monofilament yarn, the polymer chains are preferably oriented parallel to the axis of the monofilament so as to increase filament strength and modulus. The thermoplastic monofilament is preferably formed by a melt-spinning process, followed by a stretching or drawing process which orients the polymer chains, preferably parallel to the filament axis. Orientation of the polymer chains may be effected during the spinning process or during a post-extrusion drawing process. The orientation step may be followed by an annealing step which helps to lock in the orientation and may increase the crystallinity levels in the monofilament.

The thermoplastic polymer used to form the monofilament is preferably a semi-crystalline, melt-spinnable thermoplastic polymer, more preferably a semi-crystalline, fiber-forming thermoplastic polymer. Non-limiting examples of suitable semi-crystalline polymers include poly (alkylene terephthalates), poly(alkylene naphthalates), poly (arylene sulfides), aliphatic and aliphatic-aromatic polyamides, and polyesters comprising monomer units derived from cyclohexanedimethanol and terephthalic acid. Examples of specific semi-crystalline polymers include poly (ethylene terephthalate), poly(butylene terephthalate), poly (ethylene naphthalate), poly(phenylene sulfide), poly(1,4-cyclohexanedimethanol terephthalate) (wherein the 1,4-cyclohexanedimethanol is a mixture of cis and trans isomers), nylon 6 and nylon 66. Polyolefins, particularly polyethylene and polypropylene, are other semi-crystalline polymers that may be used in this invention. Extended chain polyethylene, which has a high tensile modulus, is made by the gel spinning or the melt spinning of very high or ultrahigh molecular weight polyethylene.

Preferred classes of such thermoplastic polymers include, for example, polyesters, polyamides, polyarylene sulfides, polyolefins, aliphatic-aromatic polyamides, and polyacrylates.

Preferred polyesters include the polyesters of alkylene glycols having from about 2 to about 10 carbon atoms and aromatic diacids. Polyalkylene terephthalates, especially polyethylene terephthalate and polybutylene terephthalate are particularly preferred. Also preferred are polyalkylene naphthalates, which are polyesters of 2,6-naphthalenedicarboxylic acid and alkylene glycols, such as, for example, polyethylene naphthalate.

Preferred polyamides are nylon 6 and nylon 66, which are commonly used in making fibers.

The preferred polyarylene sulfide is polyphenylene sulfide.

The preferred polyolefins are polyethylene and polypropylene.

The preferred aliphatic aromatic polyamides include polyamides derived from terephthalic acid and 2-methyl-1,5-pentanediamine.

Specific preferred polymers for use in the monofilament yarn used in the present invention include polyethylene terephthalate ("PET"), nylon 6, nylon 66, polypropylene, polybutylene terephthalate ("PBT"), and polyethylene.

The thermoplastic polymer used to form the monofilament preferably has a melting point of from about 80° C. to about 375° C.

The monofilament yarn(s) used in the present invention has a relatively large diameter. Preferably, the monofilament yarn has a diameter of preferably at least about 0.10 millimeter, more preferably from about 0.10 to about 3.00 millimeters. Because of its large diameter, the monofilament yarn used in the present invention easily maintains its three-dimensional shape after the deformation process without the benefit of a stiffening system such as a crosslinkable resin or a second thermoplastic polymer. As mentioned previously herein, the stiffness of the monofilament yarn is the primary source of the stiffness of the network structure of this invention. This is because the stiffness of a fiber is a cubic function of its diameter. Thus, doubling the diameter of a fiber will make the fiber eight times stiffer. Therefore, because the present invention uses a large-diameter monofilament yarn, the choice and quantity of the bonding agent are much less critical in the present invention than is the case for the prior art rigid network structures using multifilaments.

The monofilament yarn(s) used in the present invention preferably has a circular cross-section. Non-round cross-sections have variable stiffness, depending upon the plane in which the monofilament is bent. Both the fabric-forming process and the deformation process will tend to rotate non-round yarns so that the softest moment is the one most likely to be flexed. Consequently, the bending resistance and compression stiffness of networks formed from non-round monofilament yarns and networks formed from multifilament yarns will always be less than that of the equivalent monofilament yarn having a circular cross-section.

Because of the use of a crosslinkable resin as a bonding agent in the present invention, it may be desirable to modify, e.g., by fluting, the cross-section of the monofilament yarn while maintaining the circular aspect of the cross-section. Such modification, particularly fluting, may allow for higher resin loadings without sacrificing the aforementioned advantages of round cross-sections. Alternatively, a multifilament yarn may be added alongside the monofilament yarn to facilitate resin pick-up and wicking and to allow higher resin loadings. Multifilament yarn wrapping the monofilament yarn is a particularly desirable embodiment.

Non-limiting examples of suitable crosslinkable resins for use in the present invention include melamine resins and, in particular, phenolic resins. Because, in the methods of this invention, the resin can be cured after the deformation process and after the deformed structure has been removed from the mold, non-limiting examples of suitable resins for use in the present invention include UV-curable and water-curable resins.

The amount of crosslinkable resin used in the present invention will depend at least in part on the particular resin used and on the particular application desired of the final network structure. Typically, the deformable fabric will contain from about 10 to about 70 parts by weight of the monofilament yarn(s) and from about 30 to about 90 parts by weight of the resin.

The present invention further provides methods of making the network structure of this invention.

In the present invention, the crosslinkable resin may be added to the deformable fabric (i.e., after the fabric-forming step but before the area-enlarging step), to the initial network structure (i.e., after the area-enlarging step but before demolding), and/or to the demolded network structure. In preferred embodiments, the resin is added to the demolded network structure. However, if the resin is added before the area-enlarging deformation step, care must be exercised to ensure that curing of the resin is delayed until after the initial network structure has been formed. The resin may be applied to the deformable fabric, the initial network structure and/or the demolded network structure by any conventional method, such as, for example, by painting on, brushing on, knife application, or slop padding.

In the methods of this invention, the oriented, semi-crystalline monofilament yarn(s) is subjected to a fabric-forming process, e.g., knitting or weaving, to form a deformable fabric having a plurality of monofilament cross-over points which was defined previously herein as those points in the fabric where the monofilament yarn crosses over (i.e., intersects) itself.

The deformable fabric then undergoes an area-enlarging deformation process to form the initial network structure. The area-enlarging deformation process is carried out in a shaping mold at an elevated temperature. As used herein, the term "area-enlarging" with respect to the deformation process refers to the enlarging of the surface area of the base region of the deformable fabric in which such deformations are formed. The deformation process is preferably a deep-drawing process and the shaping mold is preferably a deep-drawing mold. The deformation of the deformable fabric is preferably brought about by using a thermomechanical process, wherein a mechanical force is applied to the deformable fabric at an elevated temperature. The mechanical force can be applied using numerous methods such as, e.g., solid phase pressure forming, vacuum bladder match plate molding, interdigitation, deep drawing, use of a heated mold, and the like. Heat and pressure are applied to the deformable fabric for a sufficient time that the textile fabric is permanently deformed but not for such a long time or at such a high temperature (e.g., approaching the crystalline melting point) that the semi-crystalline, oriented monofilament yarn begins to soften and lose orientation.

The methods of this invention can be accelerated by preheating the deformable fabric to a temperature close to the elevated temperature used in the deformation process. If the fabric is preheated close to but below the final temperature, cycle times can be reduced to a few seconds. For highest quality, the highest temperature used in the deformation process should be the final configuration temperature.

The deformation process results in an initial network structure which is resilient and self-supporting and is composed of a deformed textile fabric having a three-dimensional shape and containing a base region and a plurality of deformations disposed as a two-dimensional array on the base region. As used herein, the term "initial network structure" refers to the network structure formed in the deformation process but wherein the monofilament cross-over points have not yet been bonded to one another. As mentioned previously herein, such bonding of the monofilament cross-over points is effected by the curing of the crosslinkable resin.

As mentioned above, the initial network structure is self-supporting and resilient. As used herein, the term "self-supporting" means that the structure has sufficient stiffness as to be able to maintain its three-dimensional shape even before the monofilament cross-over points have been bonded to one another.

The deformed fabric has a three-dimensional shape and is composed of a base region and a plurality of deformations disposed as a two-dimensional array on the base region.

The initial network structure is then demolded. As mentioned previously herein, one of the benefits of using the semi-crystalline, oriented monofilament yarn is that the thermal memory of semi-crystalline, oriented monofilaments is strongly dependent upon the maximum temperature they have experienced, but only weakly dependent upon the time spent at that temperature. Consequently, in the method of this invention, demolding can be accomplished as soon as the deformed fabric reaches the desired temperature during the deformation process.

After the initial network structure has been removed from the mold, the crosslinkable resin (which has been added to the deformable fabric, the initial network structure and/or the demolded network structure) is then cured to form the final network structure. To effect curing of the resin, the demolded, resin-impregnated network structure is subjected to conditions appropriate for curing the selected resin system. For example, the demolded structure may be subjected to a temperature sufficient to effect curing of the resin. Alternatively, the demolded structure may be exposed to ultraviolet radiation to cure the resin if the resin is a UV-curable resin. If the resin is a water-curable resin, the demolded structure may then be exposed to an aqueous medium to effect curing of the resin. Because the initial network structure is stable and durable, the timing of the application and hardening of the resin is not as critical in this invention as is the case for the prior art networks. In particular, in the present invention, it is possible to delay the bonding operation until a more convenient time, possibly, for example, after the initial network structure has been formed into a useful secondary shape such as, e.g., when wrapping a pipe for making curved sandwich panels. In that case, the bonding of the monofilament cross-over points by the cured resin not only makes the network structure rigid but also serves to maintain the secondary shape.

The curing of the resin effects bonding of all or substantially all of the monofilament cross-over points in the network structure, thereby converting the initial network structure into the final network structure of this invention.

The final network structure of this invention, wherein the monofilament cross-over points are bonded together, is rigid and has improved post-yield dimensional recovery. That is, the resistance of the network structure to compression rises rapidly as the structure is compressed. At a high load, the material will yield, that is, there is a sudden softening of the network structure such that additional compression is accomplished by adding only slightly higher loads. When the compression is removed, much of the original network height will be recovered. However, resistance to compression is now much lower, i.e., the network structure has become soft.

The final network structure of this invention is also light-weight and extremely porous in all directions, and has an open-mesh, filigree-like structure.

The three-dimensionally shaped fiber network structure of this invention contains a base region and a plurality of deformations disposed as a two-dimensional array on the base region.

As used herein, the term "two-dimensional array" means that the multiple deformations are disposed both along the length and along the width of the plane of the base region.

As used herein, the term "deformations" is meant to include projections and/or depressions formed on the base region by means of an area-enlarging process which increases the surface area of the deformable fabric, i.e., the deformed fabric has a greater surface area than the deformable fabric from which it was formed. As used herein, the term "projections" refers to portions of the deformed textile fabric which extend upwardly from a first face of the base region of the deformed fabric. The term "depressions" is used herein to refer to portions of the deformed textile fabric which extend downwardly from a first face of the base region into the deformed textile fabric. The direction in which the depressions extend is substantially opposite to the direction in which the projections extend.

During the area-enlarging deformation (shaping) process, the deformable fabric undergoes stretching so as to form the deformations therein. The surface area of the resulting deformed fabric will be larger than that of the undeformed fabric, typically more than about 25% larger.

The deformations in the network structure of this invention are stretched structures as opposed to, e.g., corrugations which are not stretched but merely folded structures. The deformations can extend from the base region of the deformed fabric by a distance of several times the thickness of the fabric, thereby giving the network structure a much greater thickness and much lower apparent density than the deformable fabric.

A variety of shapes are possible for the deformations produced in the fiber network structure of this invention by the area-enlarging step. For example, the deformations can be in the form of elongated ridges, zig-zag patterns, ellipses, cones or truncated cones, pyramids or truncated pyramids on different polygonal bases, cylinders, prisms, spherical elements and the like. The deformations may have a circular or polygonal base, or may be bar-shaped. Furthermore, deformations disposed on a common base region of a deformed textile fabric formed in the present invention can vary in shape from one another, i.e., the deformations on a particular base region do not all have to be the same shape.

Preferably, the apex points or top surfaces of projections define a first surface, which is a plane parallel to the plane of the base region of the deformed textile fabric from which the projections extend. Similarly, the apex points or bottom surfaces of depressions, if present, preferably define a second surface, which is also preferably a plane parallel to the plane of the base region. As a result, the preferred three-dimensional networks of this invention have two surfaces or planes, one being defined by the top surfaces of the projections and the other being defined by either the base region of the textile fabric or the bottom surfaces of the depressions.

Depending on the use thereof, the fiber network structure of this invention may have a variety of deformations. Specifically, the shapes, heights, sizes and spacings of the deformations can be modified to suit a specific application. For example, the deformations may be modified to conform to a specific shape, e.g., an elliptical shape.

The shapes of the deformations depend on the process used to make them. For example, in a deformation process in which the textile fabric is held against a plate with round holes and a cylindrical rod is pushed through the hole on the same side as the textile fabric so that the textile fabric is stretched and forced into the hole, the resulting projections made in the textile fabric will be in the shape of truncated cones (i.e., the base and top of the projections will both be round), with the diameter of the top of the cone being the diameter of the rod that pushes the textile through the hole. Similarly, if a plate with square holes and a rod with a square cross section are used, the projections will be in the shape of truncated pyramids.

Corrugated or pleated geometries, which are formed by folding rather than by an area-enlarging process, are undesirable for the fabrics of this invention because corrugated or pleated geometries are unstable under forces perpendicular to the direction of the folds. Under compression, the corrugated structure is characterized by yield followed by a negative compression modulus, that is, after a relatively small deformation, typically 5% to 10%, the structure collapses completely under load, returning to their original flat shape. The structure may recover from collapse but will be prone to flex fracture at the fold line.

Three-dimensionally shaped fiber network structures which have deformations like those which can be present in the structure of this invention are disclosed, for example, in U.S. Pat. Nos. 5,158,821; 5,447,776; 4,631,221; and 5,364,686; each of the foregoing references being hereby incorporated by reference herein.

During the area-enlarging deformation (shaping) process, portions of the base region of the deformable fabric undergo stretching so as to form the deformations therein. After the area-enlarging deformation process, the stretched nature of the deformations of the base region causes the base region to have a larger surface area than the corresponding base region of the original deformable fabric. However, although the area-enlarging deformation process increases the surface area of the base region of the deformable fabric, the deformation process does not change the length or width of such base region. The total surface area of the network structure is substantially larger than the surface area of the deformable fabric, typically more than about 25% larger.

The present invention further provides articles containing the three-dimensionally shaped fiber network structure of this invention.

Because of its properties, the fiber network structure of this invention is useful as a core in sandwich panels, spacers in double-walled pipes and vessels, as ventilation spacers between structural elements, drainage systems, energy absorption structures, ground stabilization, embedded reinforcements, shapable forms and architectural products.

The stiffness and load-bearing capabilities of the network structure of this invention are determined primarily by the stiffness of the individual monofilament fibers and the strength of the monofilament crossover bonds. The rigidity of the individual fibers is determined by their diameters, their level of molecular orientation, their cross-sectional shape, and the intrinsic stiffness of the thermoplastic polymer used to form such monofilaments. The strength of the bonds is controlled by the type and level of the crosslinkable resin which is used as the bonding agent for the monofilament crossover points. The sizes, heights and shapes of the deformations and the spacings of the pattern of deformations also affect the rigidity of the three-dimensional network structure of this invention. Thus, depending on the stiffness of the fibers, the bonding system, and the geometry of the network structure, the network structure of this invention may be used as structural materials, energy-absorbing materials or as embedded reinforcements.

The following non-limiting examples illustrate the present invention.

EXPERIMENTAL

EXAMPLE 1

Resilient three-dimensionally shaped fiber network structures produced by knitting a 180-micron polyester monofilament and a 150-denier 33 filament textured polyester into an 11 gauge plain knit fabric. The fabric was then formed into a lightweight resilient three-dimensionally shaped fiber network structure. After the forming process was completed, the resilient networks were then topically treated with several commercially available bonding or gluing agents, including Oatley All-Purpose Cement for PVC-ABS-Cpvc, Elmers Glue - Contact Cement, Plasti Dip Spray on heavy duty Flexible Rubber Coating, and Bondo Polyester Fiberglass Resin. In all cases, the compression modulus of the bonded networks increased dramatically and was found to be several times stiffer than the unbonded resilient network. The relative stiffness is the ratio of the samples' compression modulus to that of the unbonded precursor network.

TABLE I

| Bonding Agent | Yield Stress (psi) | Yield Strain (%) | Relative Stiffness | Weight Increase (%) |
|---|---|---|---|---|
| None | 0.096* | 0 | 1 | 0 |
| Rubber Spray | 0.9 | 39 | 9.2 | 29 |
| PVC Cement | 1.27 | 31 | 16 | 13 |
| Contact Cement | 2.65 | 23 | 37 | 30 |
| Bondo | 61 | 19 | 964 | 235 |

*Load at 25% compression. Sample was resilient.

What is claimed is:

1. A rigid three-dimensionally shaped fiber network structure having improved post-yield dimensional recovery, comprising a deformed sheet-like textile fabric having a base region and a plurality of deformations formed as a two-dimensional array on the base region, wherein the deformed fabric contains:

(A) at least one oriented, semi-crystalline monofilament yarn containing a thermoplastic polymer, the monofilament yarn being disposed in the deformed fabric so as to provide a plurality of monofilament cross-over points therein; and (B) a cured crosslinkable resin impregnating the deformed fabric so as to effect bonding of all or substantially all of the monofilament cross-over points.

2. A network structure according to claim 1, wherein the monofilament yarn has a diameter of at least about 0.10 millimeter.

3. A network structure according to claim 1, wherein the monofilament yarn has a diameter of from about 0.10 to about 3.00 millimeter.

4. A network structure according to claim 1, wherein the thermoplastic polymer is a semi-crystalline polymer selected from the group consisting of poly(alkylene terephthalates), poly(alkylene naphthalates), poly(arylene sulfides), aliphatic polyamides, aliphatic-aromatic polyamides, polyolefins, and polyesters comprising monomer units derived from cyclohexanedimethanol and terephthalic acid.

5. A network structure according to claim 1, wherein the thermoplastic polymer is a semi-crystalline polymer selected from the group consisting of poly(ethylene terephthalates), poly(butylene terephthalates), poly(ethylene naphthalates), poly(phenylene sulfides), nylon 6, nylon 66, polyethylene, polypropylene, and poly(1,4-cyclohexanedimethanol terephthalate) wherein the 1,4-cyclohexanedimethanol is a mixture of cis and trans isomers.

6. A network structure according to claim 1, wherein the resin is a melamine resin.

7. A network structure according to claim 1, wherein the resin is a phenolic resin.

8. A network structure according to claim 1, wherein the resin is a UV-curable resin.

9. A network structure according to claim 1, wherein the resin is a water-curable resin.

10. A network structure according to claim 1, wherein the thermoplastic polymer has a melting point of from about 80° C. to about 375° C.

11. A network structure according to claim 1, wherein the deformed fabric is a knitted or woven fabric.

12. A network structure according to claim 1, wherein said deformations include (i) projections extending outwardly from a first face of said base region of said deformed fabric in a direction which is substantially perpendicular to said first face of said base region or (ii) depressions extending inwardly from said first face of said base region of said deformed fabric in a direction which is substantially perpendicular to said first face of said base region.

13. A network structure according to claim 1, wherein said deformations include (i) projections extending outwardly from a first face of said base region of said deformed fabric in a direction which is substantially perpendicular to said first face of said base region and (ii) depressions extending inwardly from said first face of said base region of said deformed fabric in a direction which is substantially perpendicular to said first face of said base region.

14. An article comprising the three-dimensionally shaped fiber network structure of claim 1.

15. An article according to claim 14, wherein the article is selected from the group consisting of structural materials, energy-absorbing materials and embedded reinforcements.

16. A method of making a rigid three-dimensionally shaped fiber network structure having improved post-yield dimensional recovery, comprising the steps of:

(1) providing at least one oriented, semi-crystalline monofilament yarn comprising a thermoplastic polymer;

(2) subjecting the monofilament yarn to a fabric-forming process so as to produce a deformable fabric, the deformable fabric containing a plurality of monofilament cross-over points formed by the monofilament yarn;

(3) subjecting the deformable fabric to an area-enlarging deformation process in a shaping mold at an elevated temperature so as to form an initial, resilient, self-supporting network structure containing a deformed fabric having a three-dimensional shape, the deformed fabric having a base region and a plurality of deformations disposed as a two-dimensional array on the base region, the elevated temperature being higher than the glass transition temperature of the thermoplastic polymer so as to permanently deform the thermoplastic polymer but sufficiently below the melting temperature of the thermoplastic polymer so as to avoid softening and loss of molecular orientation of the thermoplastic polymer, the initial network structure having sufficient stiffness so as to be capable of maintaining the three-dimensional shape thereof;

(4) demolding the initial network structure;

(5) adding a crosslinkable resin to the demolded network structure to form a resin-impregnated network structure;

(6) curing the resin in the resin-impregnated network structure so as to effect bonding of all or substantially all of the monofilament cross-over points, thereby converting the demolded initial structure into a rigid three-dimensionally shaped network structure having improved post-yield dimensional recovery.

17. A method according to claim 16, wherein the crosslinkable resin is a UV-curable resin, further wherein curing of the resin is effected by subjecting the resin-impregnated demolded structure to ultraviolet radiation.

18. A method according to claim 16, wherein the crosslinkable resin is a water-curable resin, further wherein curing of the resin is effected by subjecting the resin-impregnated demolded structure to an aqueous medium.

19. A method according to claim 16, wherein the monofilament yarn has a diameter of at least about 0.10 millimeter.

20. A method according to claim 16, wherein the thermoplastic polymer is a semi-crystalline polymer selected from the group consisting of poly(alkylene terephthalates), poly(alkylene naphthalates), poly(arylene sulfides), aliphatic polyamides, aliphatic-aromatic polyamides, polyolefins, and polyesters comprising monomer units derived from cyclohexanedimethanol and terephthalic acid.

21. A method according to claim 16, wherein the thermoplastic polymer has a melting point of from about 80° C. to about 375° C.

22. A method according to claim 16, wherein the crosslinkable resin is a melamine resin.

23. A method according to claim 16, wherein the crosslinkable resin is a phenolic resin.

24. A method of making a rigid three-dimensionally shaped fiber network structure having improved post-yield dimensional recovery, comprising the steps of:

(1') providing at least one oriented, semi-crystalline monofilament yarn comprising a thermoplastic polymer;

(2') subjecting the monofilament yarn to a fabric-forming process so as to produce a deformable fabric, the deformable fabric containing a plurality of monofilament cross-over points formed by the monofilament yarn;

(3') applying a crosslinkable resin to the deformable fabric to form a resin-impregnated deformable fabric;

(4') subjecting the resin-impregnated deformable fabric to an area-enlarging deformation process in a shaping mold at an elevated temperature so as to form an initial, resilient, self-supporting, resin-impregnated network structure containing a deformed fabric having a three-dimensional shape, the deformed fabric having a base region and a plurality of deformations disposed as a two-dimensional array on the base region, the elevated temperature being higher than the glass transition temperature of the thermoplastic polymer so as to permanently deform the thermoplastic polymer but sufficiently below the melting temperature of the thermoplastic polymer so as to avoid softening and loss of molecular orientation of the thermoplastic polymer, the initial network structure having sufficient stiffness so as to be capable of maintaining the three-dimensional shape thereof;

(5') demolding the initial resin-impregnated network structure; and (6') curing the resin in the resin-impregnated network structure so as to effect bonding of all or substantially all of the monofilament cross-over points, thereby converting the demolded initial structure into a rigid three-dimensionally shaped network structure having improved post-yield dimensional recovery.

25. A method of making a rigid three-dimensionally shaped fiber network structure having improved post-yield dimensional recovery, comprising the steps of:

(1") providing at least one oriented, semi-crystalline monofilament yarn comprising a thermoplastic polymer;

(2") subjecting the monofilament yarn to a fabric-forming process so as to produce a deformable fabric, the deformable fabric containing a plurality of monofilament cross-over points formed by the monofilament yarn;

(3") subjecting the deformable fabric to an area-enlarging deformation process in a shaping mold at an elevated temperature so as to form an initial, resilient, self-supporting network structure containing a deformed fabric having a three-dimensional shape, the deformed fabric having a base region and a plurality of deformations disposed as a two-dimensional array on the base region, the elevated temperature being higher than the glass transition temperature of the thermoplastic polymer so as to permanently deform the thermoplastic polymer but sufficiently below the melting temperature of the thermoplastic polymer so as to avoid softening and loss of molecular orientation of the thermoplastic polymer, the initial network structure having sufficient stiffness so as to be capable of maintaining the three-dimensional shape thereof;

(4") applying a crosslinkable resin to the initial network structure to form a resin-impregnated initial network structure;

(5") demolding the initial resin-impregnated network structure; and (6") curing the resin in the resin-impregnated network structure so as to effect bonding of all or substantially all of the monofilament cross-over points, thereby converting the demolded initial structure into a rigid three-dimensionally shaped network structure having improved post-yield dimensional recovery.

* * * * *

UNITED STATES PATENT AND TRADEMARK OFFICE
CERTIFICATE OF CORRECTION

PATENT NO. : 5,851,930

DATED : December 22, 1998

INVENTOR(S) : Bessey et al.

It is certified that error appears in the above-identified patent and that said Letters Patent is hereby corrected as shown below:

Title page, item [75], in the third inventor's address, "Charlotte, N.C." should read --Sunset Beach, N.C.--.

Column 14, line 33, "3.00" should read --1.00--.

Signed and Sealed this

Sixth Day of July, 1999

*Attest:*

*Attesting Officer*

Q. TODD DICKINSON

*Acting Commissioner of Patents and Trademarks*